US010665933B2

(12) United States Patent
Tankielun et al.

(10) Patent No.: US 10,665,933 B2
(45) Date of Patent: May 26, 2020

(54) ANTENNA UNIT, RADIO FREQUENCY CIRCUIT AND METHOD FOR MANUFACTURING AN ANTENNA UNIT

(71) Applicant: Rohde & Schwarz GmbH & Co. KG, Munich (DE)

(72) Inventors: Adam Tankielun, Ottobrunn (DE); Arslan Azhar, Munich (DE); Stefan Zorn, Deggendorf (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 155 days.

(21) Appl. No.: 15/332,779

(22) Filed: Oct. 24, 2016

(65) Prior Publication Data

US 2018/0115079 A1 Apr. 26, 2018

(51) Int. Cl.
*H01Q 1/38* (2006.01)
*H01Q 13/08* (2006.01)

(52) U.S. Cl.
CPC ..... *H01Q 1/38* (2013.01); *H01Q 13/085* (2013.01)

(58) Field of Classification Search
CPC ..... H01Q 13/106; H01Q 13/085
See application file for complete search history.

(56) References Cited

U.S. PATENT DOCUMENTS 7,009,572 B1 * 3/2006 Homer ..... H01Q 13/085 343/767
8,504,135 B2 * 8/2013 Bourqui ..... H01Q 13/085 343/785
9,142,889 B2 9/2015 Pazin et al.
9,606,158 B2 * 3/2017 Tankielun ..... G01R 29/105

OTHER PUBLICATIONS

Final Office Action from U.S. Appl. No. 15/600,628 dated Jan. 2, 2019, 13 pgs.
Non-Final Office Action from U.S. Appl. No. 15/600,628 dated Jan. 10, 2020, 18 pages.

* cited by examiner

*Primary Examiner* — Daniel Munoz
*Assistant Examiner* — Amal Patel
(74) *Attorney, Agent, or Firm* — Schwabe, Williamson & Wyatt, P.C.

(57) ABSTRACT

An antenna unit for receiving and/or emitting electromagnetic waves having a certain wavelength is described. Said antenna unit is a slotline antenna unit having a slot region. Said antenna unit comprises at least one antenna element and a carrier. Said carrier is made by a dielectric material wherein said carrier has at least one cutout in said slot region. Said antenna element is made by a printed circuit board. Said antenna element and said carrier are attached to each other wherein said carrier has a thickness being less than one fifth of said wavelength. Further, a radio frequency circuit and a method for manufacturing an antenna unit are described.

14 Claims, 2 Drawing Sheets

ANTENNA UNIT, RADIO FREQUENCY CIRCUIT AND METHOD FOR MANUFACTURING AN ANTENNA UNIT

TECHNICAL FIELD

The invention relates to an antenna unit for receiving and/or emitting electromagnetic waves having a certain wavelength and a method for manufacturing an antenna unit.

BACKGROUND OF THE INVENTION

In the state of the art, tapered slotline antennas (TSAs) are known which are used for determining and/or measuring radiation and signal characteristics of wireless devices over the air (OTA measurements). The tapered slotline antennas are also called Vivaldi antennas. For instance, such tapered slotline antennas can be used for testing devices under test (DUTs) such as communication devices in certain frequency ranges. The tapered slotline antennas may be formed by a printed circuit board having a low thickness.

However, the small thickness of such tapered slotline antennas results in a low mechanical stability. Thus, the risk is high that the tapered slotline antenna gets damaged while using the tapered slotline antenna.

Further, it is known to use a bulky dielectric holder which supports the tapered slotline antenna such that the mechanical stability is improved. However, the bulky dielectric holder influences the radiation performance of the tapered slotline antenna. For instance, reflections occur resulting in side lobes in the radiation pattern which are not desired. These side lobes negatively affect the radiation performance of the slotline antenna.

Besides the tapered slotline antennas standard, gain horn (SGH) antennas may be used which have a higher mechanical robustness.

Accordingly, the antenna units known in the prior art do not have satisfying characteristics regarding their mechanical robustness and radiation performance. Thus, there is a need for an antenna unit having both good radiation performance and mechanical robustness.

SUMMARY OF THE INVENTION

The invention provides an antenna unit for receiving and/or emitting electromagnetic waves having a certain wavelength, said antenna unit being a tapered slotline antenna unit having a slot region, said antenna unit comprising at least one antenna element and a carrier, said carrier being made by a dielectric material wherein said carrier has at least one cutout in said slot region, said antenna element being made by a printed circuit board, said antenna element and said carrier being attached to each other wherein said carrier has a thickness being less than one fifth of said wavelength.

The invention is based on the finding that the antenna unit has better mechanical characteristics like robustness and stiffness since the antenna element is supported by the carrier. In addition, the carrier has a shape which does not negatively affect the electromagnetic performance of the antenna unit, in particular the radiation and signal characteristics. Since the thickness of the carrier is less than one fifth of said wavelength ($<\lambda/5$) the whole antenna unit is compact even though the mechanical robustness of the antenna unit is improved. Furthermore, the antenna unit has a more directive radiation pattern wherein the side lobes are reduced with respect to mechanically robust tapered slotline antennas known in the prior art. Accordingly, the radio frequency performance of the antenna unit is improved. The slotline region is inter alia defined by two conductive portions being arranged axially symmetrical to each other with respect to the main direction. Between both conductive portions, a slot is provided that widens to the end of antenna unit being the aperture. The tapered slotline antenna is configured to emit electromagnetic waves in the microwave range. Generally, the antenna unit is configured to be used for measuring inter alia 802.11ad and 5G devices under test (DUTs) in a frequency range being lager than 18 GHz.

Moreover, the antenna unit is configured to be used as a part of a power sensor measuring the power of a device under test over the air.

According to an aspect, said carrier has at least two carrier portions being partially separated by said cutout. The cutout is located in a region of the antenna unit where the power density of the electromagnetic signals radiated by the antenna unit is high. This ensures that the carrier does not impair the radio frequency performance of the antenna unit, in particular the radiation and signal characteristics.

Further, said carrier may have at least one bridge portion interconnecting both carrier portions. Thus, the carrier is made in one piece ensuring that the whole antenna unit is attached to one single carrier. In other words, the slot formed within the carrier does not extend over the whole length of the carrier.

According to one embodiment, said bridge portion is located at that end of said slot region being wider. Accordingly, the bridge portion is located next to the aperture of the antenna unit wherein the aperture is provided at the end of the slot region being wider. In other words, a person facing the antenna unit, in particular the aperture of the antenna unit, looks at the bridge portion directly. Hence, the cutout is not visible. Thus, the bridge portion covers the cutout.

According to another embodiment, said bridge portion is located at that end of said slot region being narrower. This means that the bridge portion does not cover the cutout when looking at the aperture of the antenna unit.

Particularly, said bridge portion maybe smaller in radiation direction than said wavelength. This ensures that the carrier, in particular the bridge portion, does not negatively affect the radio frequency performance of the antenna unit.

According to another aspect, said carrier is formed by a material having a relative electrical permittivity being less than 10. This electrical permittivity of the material used for the carrier ensures that the electromagnetic interaction between the carrier and the radiation pattern emitted by the antenna unit is minimized.

Generally, the carrier is made of a material having a different electrical permittivity than the antenna element.

According to a certain embodiment, said antenna element and said carrier both are formed by a printed circuit board panel. Thus, the antenna unit is structured by layers defined by the printed circuit board panels. Therefore, the antenna unit maybe a multilayer printed circuit board device.

Generally, the carrier may be made by a printed circuit board or any other dielectric element being formed like a plate. The dielectric material ensures that the electromagnetic influence of the carrier is minimized.

Furthermore, said carrier may be configured such that it provides mechanical stiffness without impairing the radio frequency characteristics of said antenna unit. As already mentioned, the carrier has a positive influence on the mechanical properties of the antenna unit, in particular improving the mechanical stiffness and/or robustness of the antenna unit due to the additional material. In addition, the carrier is made by a certain dielectric material ensuring that the radio frequency performance of the antenna unit is not negatively affected by the carrier. Furthermore, the carrier has a shape which reduces the reflections of the electromagnetic waves emitted which in turn improves the radio frequency performance of the antenna unit, in particular the directivity.

According to an aspect, said carrier and said antenna element are chemically or mechanically attached to each other. Thus, the carrier and the antenna element can be connected with each other in different ways wherein the type of connection may depend on the field of application intended.

Particularly, said carrier and said antenna element are attached to each other by adhering, riveting, screwing, soldering, brazing, clamping and/or form fit. These types of connections ensure that the carrier and the antenna element can be attached to each other easily and in a cost-efficient way. Depending on the field of application, a certain type of connection might be preferred.

The invention further provides a radio frequency circuit comprising an antenna unit as mentioned above. For instance, this radio frequency circuit is a power sensor and/or part of a measurement system. Accordingly, the radio frequency circuit may also comprise at least one up-converter and/or one down-converter.

The invention also provides a method for manufacturing an antenna unit for receiving and/or emitting electromagnetic waves having a certain wavelength, said antenna unit comprising at least one antenna element made by a printed circuit board and a carrier made by a dielectric material, said carrier having a thickness being less than one fifth of said wavelength wherein said antenna element and said carrier are attached to each other. As already mentioned, the carrier does not negatively influence the electromagnetic performance of the antenna element, but it improves the mechanical stiffness even though a small sized antenna unit is provided. Generally, the carrier and the antenna element are attached to each other in order to form the antenna unit having good radiation characteristics and good mechanical properties, in particular stiffness.

According to an aspect, said antenna element and said carrier are attached to each other by adhering, riveting, screwing, soldering, brazing, clamping and/or form fit. Thus, the carrier and the antenna element can be connected with each other easily.

In general, a mechanical or chemical connection is provided.

BRIEF DESCRIPTION OF DRAWINGS

The invention will now be described with reference to exemplary embodiments which are shown in the enclosed drawings. In the drawings, FIG. 1 schematically shows an antenna unit according to a first embodiment of the invention in a top view, FIG. 2 schematically shows a cross sectional view of the antenna unit shown in FIG. 1, FIG. 3 schematically shows an antenna unit according to a second embodiment of the invention in a top view, and FIG. 4 schematically shows a cross sectional view of the antenna unit shown in FIG. 3.

DETAILED DESCRIPTION

Figure 1:
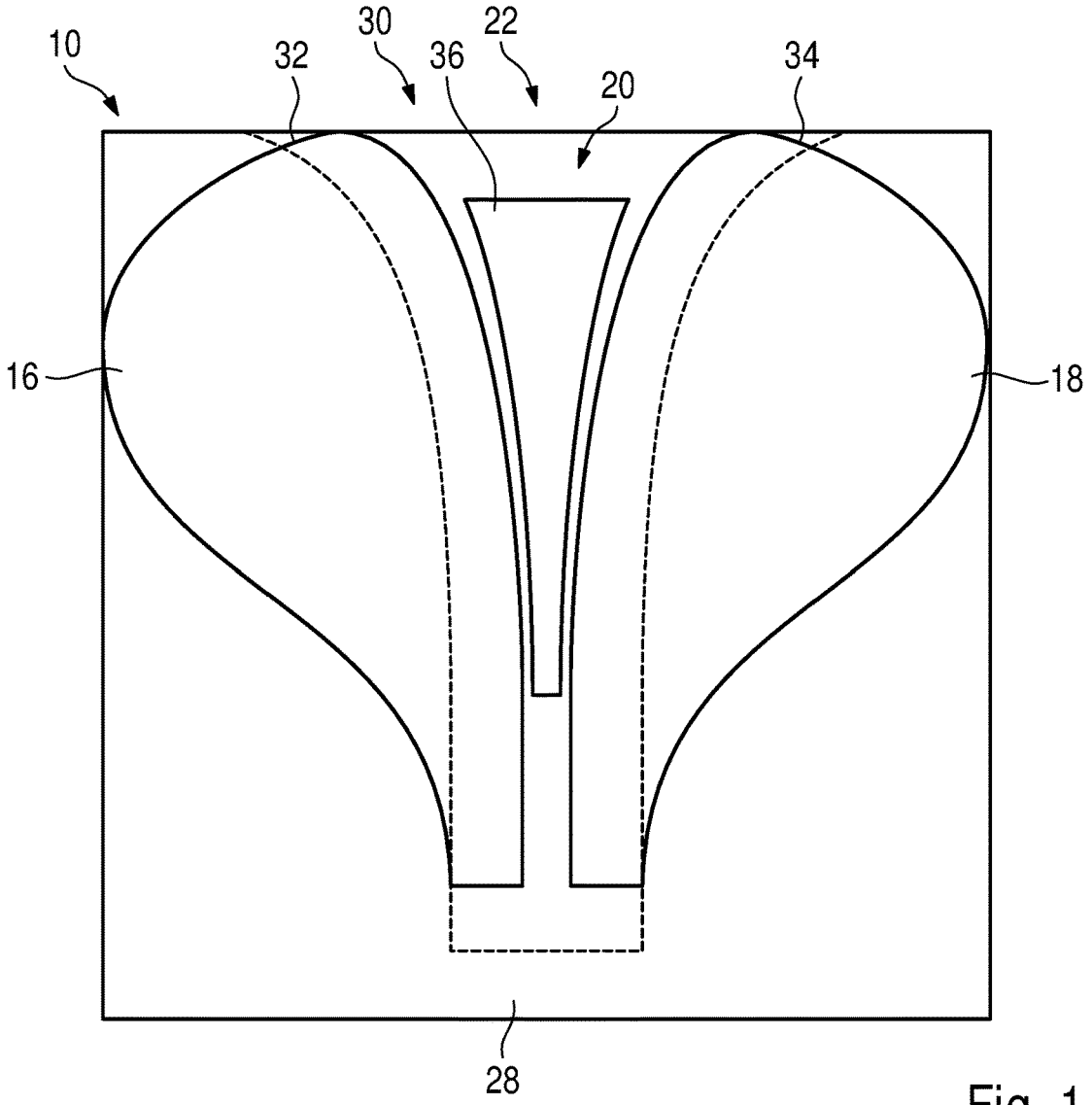
Figure 2:
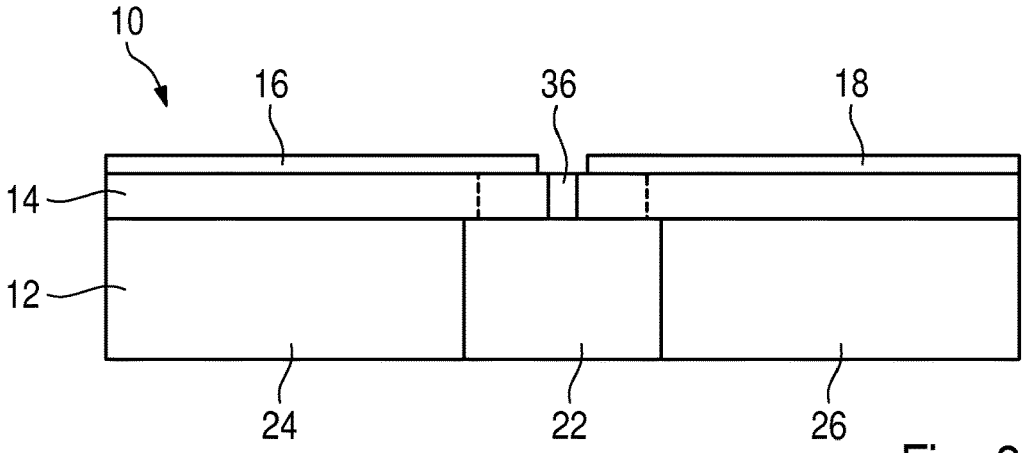

In FIGS. 1 and 2, an antenna unit 10 is shown which comprises a carrier 12, an antenna element 14 and two conductive portions 16, 18.

The antenna unit 10 is a tapered slotline antenna unit as can be seen in FIG. 1, in particular regarding the shapes of the conductive portions 16, 18 being axial symmetrically arranged with respect to each other wherein the axis is provided by the main direction of the antenna unit 10.

Therefore, the antenna unit 10 comprises a slot region 20 which separates both conductive portions 16 and 18 as can be seen in FIG. 1. The slot formed within the slot region 20 widens to an end of the antenna unit 10.

Further, the carrier 12 comprises at least one cutout 22 which is located in said slot region 20 (please refer to FIG. 1).

The carrier 12 also comprises two carrier portions 24, 26 which mainly correspond to both conductive portions 16, 18. Hence, the carrier 12 supports the antenna element 14 at least in the regions where the antenna element 14 is covered by the conductive portions 16, 18.

Further, the carrier 12 has a bridge portion 28 which interconnects the carrier portions 24, 26 as can be seen in FIG. 1. In the shown embodiment, the bridge portion 28 is located at that end of the cutout 22 or the slot region 20 being narrower. Thus, the bridge portion 28 does not cover the cutout 22 in a perspective on the aperture 30 of the antenna unit 10 which is defined by the tapered portions 32, 34 of both conductive portions 16, 18. In other words, the cutout 22 is visible when looking on that end of the antenna unit 10 defining the aperture 30. The aperture 30 corresponds to the output of the antenna unit 10 which emits the electromagnetic waves. Further, the slot region 20 widens towards the aperture 30.

As can be seen in FIG. 1, the cutout 22 also widens towards the aperture 30. The edges of the carrier 12 limiting the cutout 22 are substantially parallel to the edges of the conductive portions 16, 18 facing each other.

Moreover, the antenna element 14 has a wedge-like recess 36 which is located in the slot region 20 as can be seen in FIG. 1. This recess 36 also positively influences the radiation pattern of the antenna unit 10.

Generally, the shape of the carrier 12 as well as the antenna element 14 ensures that the antenna unit 10 has good electromagnetic performance characteristics. Thus, the carrier 12 is made of a material and shaped such that the carrier 12 does not impair the performance characteristics of the antenna unit 10.

The carrier 12 is made by a material having an electrical permittivity being less than the one of the antenna element 14. For instance the material of the carrier 12 has a relative electrical permittivity being less than 10.

In the shown embodiment, the carrier 12 is made by a printed circuit board panel wherein the antenna element 14 is also made by a printed circuit board panel. The carrier 12 and the antenna element 14 are attached to each other in order to form the antenna unit 10, in particular adhered or glued together. Alternatively, the carrier 12 is made by a dielectric material being formed like a plate.

Instead of an adhesive connection, the carrier 12 and the antenna element 14 can be attached to each other by riveting, screwing, soldering, brazing, clamping and/or form fit. Generally, a mechanical or chemical attachment is provided.

As can be seen in FIG. 2, the antenna unit 10 is formed in a superposed manner since the carrier 12, the antenna element 14 as well as the conductive portions 16, 18 are formed like layers being arranged in superposition. Thus, the antenna unit 10 is a multilayered device. In other words, the antenna unit is formed like a stack as shown in FIG. 2.

Generally, the carrier 12 is used for improving the mechanical stiffness and robustness of the antenna unit 10.

However, the carrier 12 has a thickness being less when one fifth of the wavelength of the electromagnetic waves emitted by the antenna unit 10. This ensures a compact antenna unit 10 being less bulky even though it has a high mechanical stability.

Figure 3:
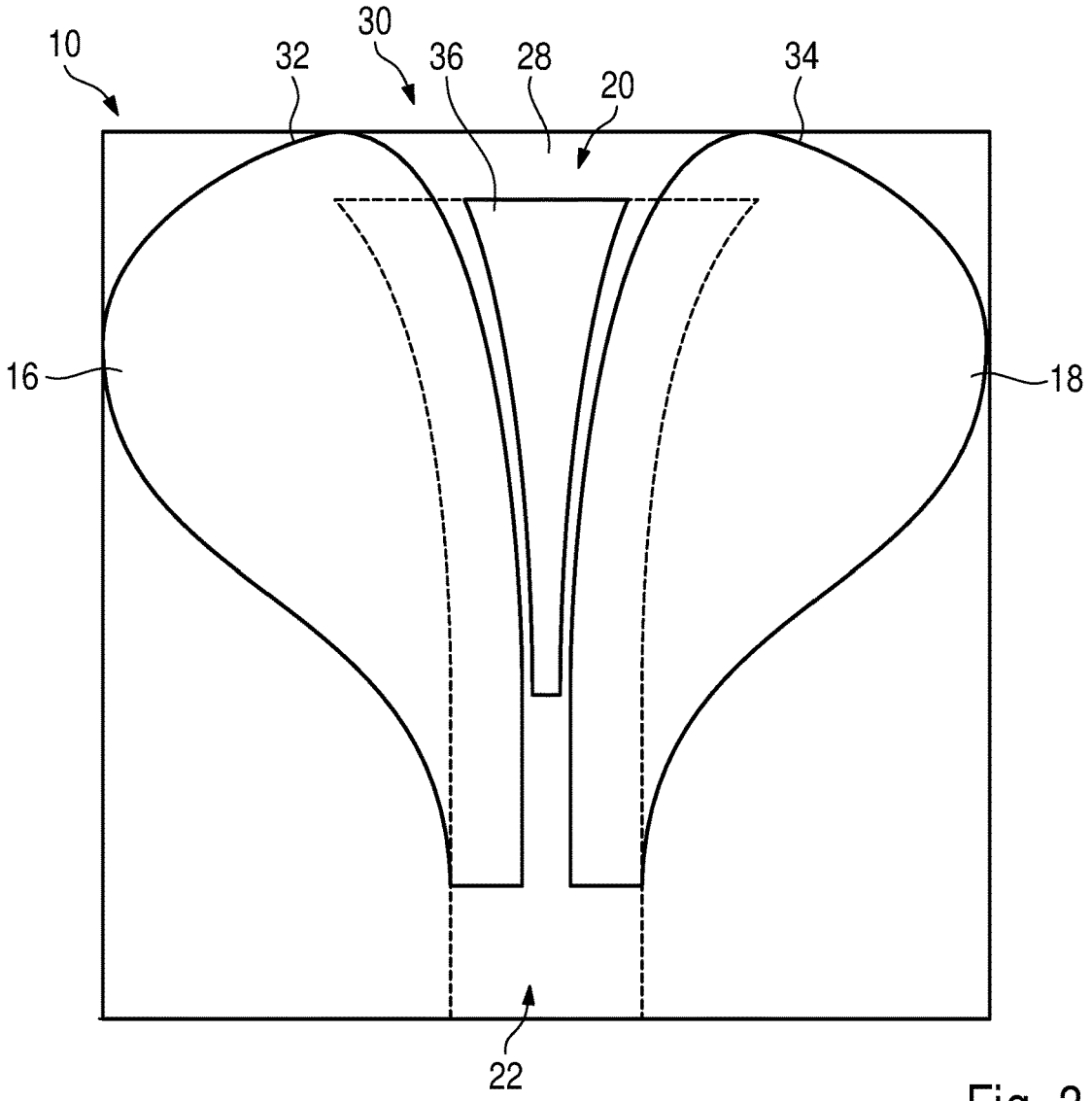
Figure 4:
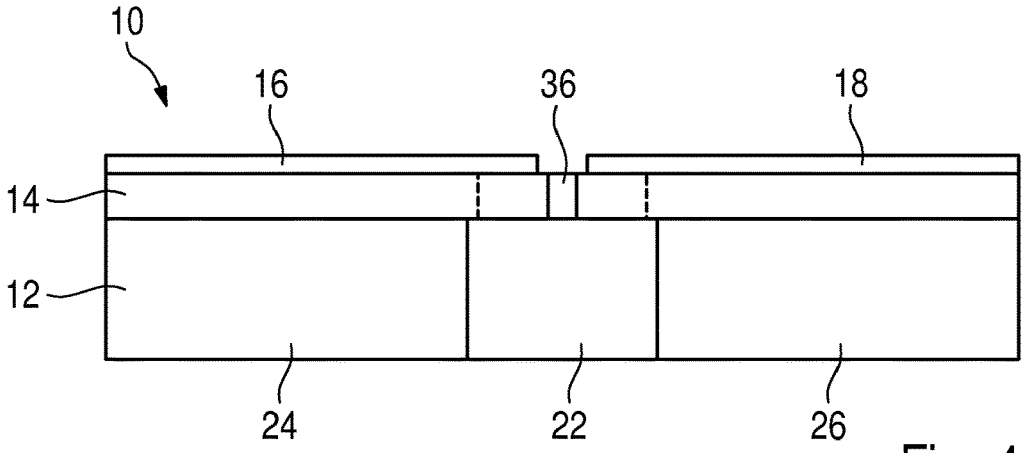

In FIGS. 3 and 4, a second embodiment of the antenna unit 10 is shown which differs to the one shown in FIGS. 1 and 2 in that the bridge portion 28 is located at that end of the slot region 20 being wider.

Thus, the bridge portion 28 is located next to the aperture 30 of the antenna unit 10. Accordingly, the bridge portion 28 covers the cutout 22 within the carrier 12 when viewing on the aperture 30 of the antenna unit 10.

However, both embodiments show that the carrier 12 has an open end formed by the cutout 22 and a closed opposite end formed by the bridge portion 28 with regard to the slot region 20.

Further, the cutout 22 is located in the slot region 20 of the antenna unit 10 since the power density is high in the slot region 20.

Generally, the bridge portion 28 is smaller in radiation direction of the antenna unit 10 than the wavelength of the electromagnetic waves emitted by the antenna unit 10. This ensures that the carrier 12, in particular the bridge portion 28, does not impair the radio frequency characteristics of the antenna unit 10.

The antenna unit 10 is configured to be used with frequencies up to about 85 GHz.

In general, a broadband antenna unit 10 is provided which can be used in a frequency range between 400 MHz and 85 GHz. Accordingly, the thickness of the carrier 12 is one fifth of the wavelength of the electromagnetic waves being the highest one which is processed by the antenna unit 10.

The antenna unit 10 is easy to manufacture since the carrier 12 and the antenna element 14 are attached to each other in a mechanical or chemical manner.

In general, a tapered slotline antenna unit 10 is provided which has small size and good radio frequency performance. Thus, the antenna unit 10 is suitable for integration with a radio frequency circuit and cross-polarized antennas.

Accordingly, an inexpensive antenna unit 10 is provided which can be used for measuring and analyzing purposes in a cost-efficient manner.

The invention claimed is:

1. An antenna unit for receiving and/or emitting electromagnetic waves having a certain wavelength, said antenna unit being a slotline antenna unit having a slot region, said antenna unit comprising at least one antenna element and a carrier having at least one bridge portion located at one end of the carrier, said carrier being made by a dielectric material wherein said carrier has at least one cutout in said slot region, said antenna element being made by a printed circuit board and including a conductive layer formed on top of the carrier, said antenna element and said carrier being attached to each other wherein said carrier has a thickness being less than one fifth of said wavelength, and wherein said slot region extends along substantially an entire length of the carrier to the bridge portion forming at least two carrier portions, said at least two carrier portions being separated by said cutout and extending from a first end of said carrier to the bridge portion and to a second opposite end of the carrier and forming two conductive portions, wherein a recess is formed in the antenna element over the cutout, and wherein the recess is located between the two conductive portions.

2. The antenna unit according to claim 1, wherein the bridge portion is smaller than the radiated wavelength in a radiation direction of the antenna unit.

3. The antenna unit according to claim 2, wherein said bridge portion interconnects both carrier portions.

4. The antenna unit according to claim 1, wherein said bridge portion is located at a first end of said slot region that is wider than a second opposite end of the slot region.

5. The antenna unit according to claim 1, wherein said bridge portion is located at a second end of said slot region that is narrower than a first opposite end of the slot region.

6. The antenna unit according to claim 1, wherein said bridge portion is smaller in radiation direction than said wavelength.

7. The antenna unit according to claim 1, wherein said carrier is formed by a material having a relative electrical permittivity being less than 10.

8. The antenna unit according to claim 1, wherein said antenna element and said carrier both are formed by a printed circuit board panel.

9. The antenna unit according to claim 1, wherein said carrier is configured such that it provides mechanical stiffness without impairing the radio frequency characteristics of said antenna unit.

10. The antenna unit according to claim 1, wherein said carrier and said antenna element are chemically or mechanically attached to each other.

11. The antenna unit according to claim 1, wherein said carrier and said antenna element are attached to each other by adhering, riveting, screwing, soldering, brazing, clamping and/or form fit.

12. A method for manufacturing an antenna unit for receiving and/or emitting electromagnetic waves having a certain wavelength, said antenna unit being a slotline antenna unit having a slot region, said antenna unit comprising at least one antenna element made by a printed circuit board and a carrier made by a dielectric element, said carrier having a thickness being less than one fifth of said wavelength wherein said antenna element and said carrier are attached to each other, wherein said carrier is provided with at least one cutout in said slot region, and wherein said carrier includes at least one bridge portion, wherein the bridge portion is smaller than a radiated wavelength in a radiation direction of the antenna unit, wherein said bridge portion of said carrier is located at a first end of the slot region that is wider than a second opposite end of the slot region.

13. The method according to claim 12, wherein said antenna element and said carrier are attached to each other by adhering, riveting, screwing, soldering, brazing, clamping and/or form fit.

14. An antenna unit for receiving and/or emitting electromagnetic waves having a certain wavelength, said antenna unit being a slotline antenna unit having a slot region, said antenna unit comprising at least one antenna element and a carrier, said carrier being made by a dielectric material wherein said carrier has at least one cutout in said region, said antenna element being made by a printed circuit board, said antenna element and said carrier being attached to each other wherein said carrier has a thickness being less than one fifth of said wavelength, and wherein said carrier has at least one bridge portion, wherein the bridge portion is smaller than said wavelength in radiation direction of the antenna unit, wherein said bridge portion of said carrier is located at a first end of the slot region that is wider than a second opposite end of the slot region.

* * * * *